US009393678B2

(12) United States Patent
Berthier

(10) Patent No.: US 9,393,678 B2
(45) Date of Patent: Jul. 19, 2016

(54) HEAD BOLT TIGHTENING TOOL FOR A CONE CRUSHER HEAD ASSEMBLY

(75) Inventor: Romain Berthier, Saint Jean d'Ardieres (FR)

(73) Assignee: Metso Minerals (France) S.A., Macon (FR)

( * ) Notice: Subject to any disclaimer, the term of this patent is extended or adjusted under 35 U.S.C. 154(b) by 533 days.

(21) Appl. No.: 13/615,812

(22) Filed: Sep. 14, 2012

(65) Prior Publication Data

US 2014/0076113 A1 Mar. 20, 2014

(51) Int. Cl.

*B25B 23/00* (2006.01)
*B25B 11/00* (2006.01)
*B25B 21/00* (2006.01)

(52) U.S. Cl.

CPC ..... *B25B 23/0078* (2013.01); *B25B 11/00* (2013.01); *B25B 21/005* (2013.01); *B25B 23/0085* (2013.01)

(58) Field of Classification Search

CPC ..... B25B 13/48; B25B 23/00; B25B 15/02; B25B 29/003; B25B 29/007; B25B 23/0078

USPC ..... 81/462, 433; 269/47, 289, 292, 297

See application file for complete search history.

(56) References Cited

U.S. PATENT DOCUMENTS 1,812,816 A * 6/1931 Weaver ..... B25B 21/002 192/150
3,279,045 A * 10/1966 Dixon ..... 29/809
4,660,447 A * 4/1987 Rossi ..... B60B 29/007 254/120
4,969,625 A 11/1990 Singer et al.
5,026,033 A * 6/1991 Roxy ..... B23Q 3/103 269/309
5,107,599 A * 4/1992 Marincic ..... G01B 5/0004 269/309
5,544,554 A * 8/1996 Brightly ..... B25H 1/0028 29/240
5,984,293 A * 11/1999 Abrahamson ..... B23Q 1/035 269/236
6,264,186 B1 * 7/2001 Hill ..... 269/47

FOREIGN PATENT DOCUMENTS

EP 2314827 A2 4/2011
WO 2010/086488 A1 8/2010

OTHER PUBLICATIONS

Australian Office Action corresponding to Australian Patent Application No. 2012216863 issued on May 1, 2015.

* cited by examiner

*Primary Examiner* — Robert Scruggs
(74) *Attorney, Agent, or Firm* — Andrus Intellectual Property Law, LLP

(57) ABSTRACT

A head bolt tightening tool for a cone crusher head assembly includes a support which is able to support the head assembly non-rotatably on the support, and a reaction arm equipment which is fitted to the support and which is able to hold a head bolt tightening wrench non-rotatably relative to the support.

18 Claims, 1 Drawing Sheet

HEAD BOLT TIGHTENING TOOL FOR A CONE CRUSHER HEAD ASSEMBLY

TECHNICAL FIELD

The invention relates to a head bolt tightening tool for a cone crusher head assembly.

BACKGROUND

In a cone crusher, a crushing chamber is formed between a stationary outer blade and a movable inner blade. The inner blade is also called a mantle. The mantle is mounted on a movable head (support cone) which is bearing-mounted outside an eccentric. A crushing force is produced in the crushing chamber by moving the head assembly, i.e. the head with the mantle radially with help of the eccentric.

The mantle is forming a changeable inner wear part in the crushing chamber. The mantle is fixed on the movable head by screwing a head bolt through the mantle to the head. Up to now, the fixation of the mantle on the movable head was achieved by hitting a wrench with a hammer for tightening the head bolt. This process is dangerous because of the hazardous working conditions. The operator is in risk of slipping and hitting wrong targets with the hammer.

An object of the invention is to improve the tightening process of the mantle of the cone crusher. A particular object is to improve safety in the workplace.

SUMMARY

According to an example aspect of the invention there is provided a head bolt tightening tool for a cone crusher head assembly, wherein the tool comprises:

- a support which is able to support the head assembly non-rotatably on the support,
- a reaction arm equipment which is fitted to the support and which is able to hold a head bolt tightening wrench non-rotatably relative to the support.

Preferably the tightening tool comprises rotation preventing means which are mountable to the support for preventing rotation of the head. Preferably the rotation preventing means is distance adjustable corresponding to various head sizes. Preferably the tool comprises a plurality of pins which are intended to be placed in holes in the head and a support surface comprised by the support. Preferably the support surface comprises pin holes for lower portions of the pins at prescribed distances relative to each other corresponding to the sizes of various head sizes. Preferably the support comprises slides with holes corresponding to the pin holes in the support surface. Preferably the support comprises slides with holes corresponding to the pin holes in the support surface and the slides are lockable in the support opposite the pin holes which correspond to the size of the head involved in the tightening. Preferably the reaction arm equipment comprises a mast and a reaction arm fitted to the mast. Preferably the mast is fitted to the support. Preferably the mast comprises support stages on different heights for level adjustment of the reaction arm. Preferably the tool is intended for a head assembly which comprises a mantle mounted on the head. Preferably the tool comprises a drive sleeve to be placed between the head bolt and the tightening wrench. Preferably the tightening wrench is a torque wrench. Preferably the tightening wrench is a hydraulic wrench.

With the tool the head bolt can be tightened with lesser human force by using a wrench, for example a hydraulic wrench. The tool is simple and robust and can be moved with a fork lift, for instance. With the tool the working conditions during maintenance operations on this crushing equipment can be improved.

Working with the tool allows controlling the tightening torque of the head bolt.

The head bolt can be opened easier manually after the mantle is worn out because the inner thread for the head bolt in the movable head does not break during the controlled tightening of the head bolt.

Preferably the tool is forming a mechanical structure for holding in place the head assembly and simultaneously for holding in place a head bolt tightening linkage such as the wrench. Preferably the tool comprises an assembly of rigid bodies connected with rigid joints to manage tightening forces and movement of the head bolt and to hold the head assembly stationary. An assembly of the tool and the head assembly is preferably forming a closed kinematic chain.

Various other features, objects and advantages of the invention will be made apparent from the following description taken together with the drawings.

BRIEF DESCRIPTION OF THE DRAWINGS

The invention will be described, by way of example, with reference to the accompanying schematical drawings, in which.

DETAILED DESCRIPTION

In the following description, like numbers denote like elements. It should be appreciated that the illustrated drawings are not entirely in scale, and that the drawings mainly serve the purpose of illustrating embodiments of the invention.

Figure 1:
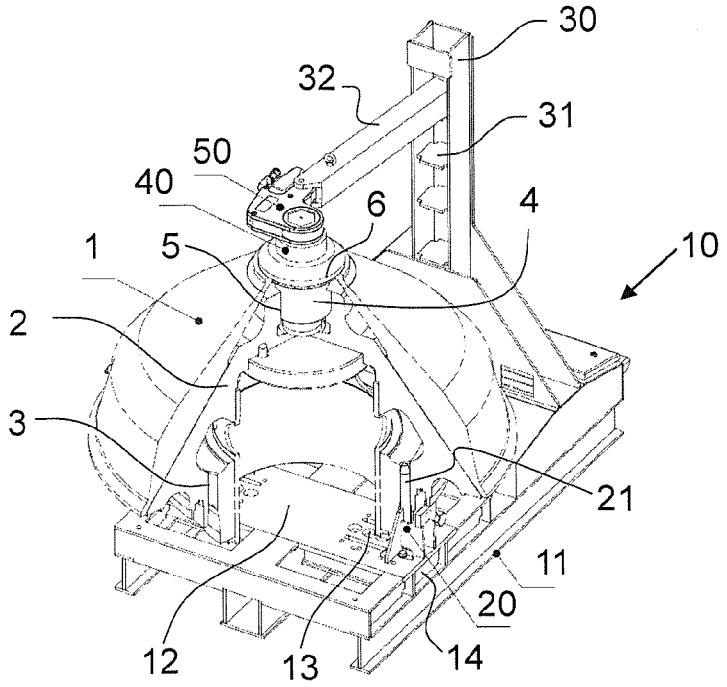
FIG. 1 shows a head assembly of a cone crusher aligned on a support of a tool for tightening of a head bolt.

FIG. 1 shows a head assembly 1, 2 of a cone crusher aligned on a support 11 of a tool 10 for tightening of a head bolt 4. The head assembly comprises a mantle 1 mounted on a head 2 (a support cone 2). Part of the tool 10 is illustrated without the head in FIG. 2. The tool provides for a safe way for tightening the head bolt. With the tool the head can be held stationary during the tightening process of the head bolt. Further the tightening force of a tightening wrench 50 fitted to the tool 10 can be transmitted controlled to the head bolt.

The head bolt 4 is mounted through an upper opening of the mantle 1 to a threaded hole in the top of the head 2 shown in FIG. 1. The head bolt 4 comprises an outer thread which is screwed in an inner thread of the head. An interface 5 of the inner and outer threads is covered in the upper direction by a torch ring 6 which is mounted between the head bolt 4 and the mantle 1. The torch ring is transmitting the tightening force from the head bolt to the mantle.

After the mantle 1 is worn out and shall be disassembled from the head 2, usually the torch ring 6 is cut off wherein the forces in the interface 5 of the inner and outer threads are released. After that the head bolt is intended to be removed by hand.

The tool 10 comprises head rotation preventing means mounted to the support 11. The support enables to support the head assembly non-rotatably on the support. Preferably the rotation preventing means comprise two pins 21, more preferably two pin assemblies 20, mounted to the support 11 (FIG. 1). Even more than two pins may be applied. The tool 10 further comprises a reaction arm equipment 30, 31, 32 which is intended to hold the tightening wrench 50 stationary (non-rotatably) relative to the support. Preferably the reaction arm equipment comprises a mast 30 to which a reaction arm 32 is fitted. The mast 30 is fitted to the support 11. Preferably the mast comprises support stages 31 on different heights for level adjustment of the reaction arm 32 depending on the size of the head 2. The tool 10 further comprises a drive sleeve 40 to be placed between the head bolt and the tightening wrench 50.

The pins 21 are mounted to the support 11 for stopping the motion of the head 2 once the head is placed on the support and particularly during the tightening operation. The support 11 comprises a support surface 12 on which the head is placed. The pins 21 are mounted to the support at selected distances from each other depending on the size of the head 2. The size (diameter, length etc.) of the pins 21 is preferably corresponding to the bottom holes 3 in the involved head size. Preferably the bottom holes 3 are formed of diametrically opposite oil discharge holes in the bottom portion of the head 2. Preferably the pins 21 are marked with the name of the machine or the corresponding head size. For mounting of the pins at a desired distance there are made pin holes 13 in the support surface at desired locations. The pin holes 13 are receiving the lower portion 22 of the pins and the bottom holes 3 in the head 2 are receiving the upper portion of the pins 21.

Figure 2:
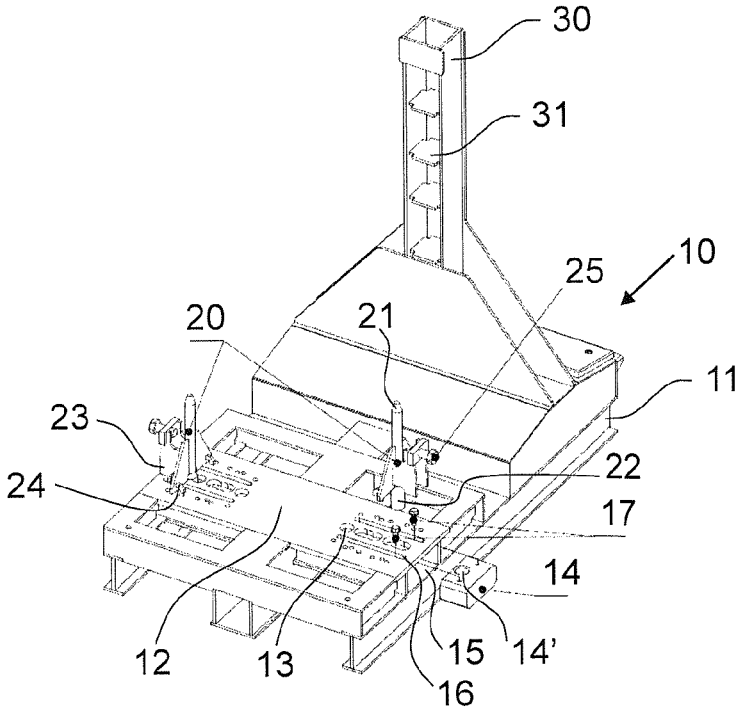
FIG. 2 shows fitting of pins to the support the tool of FIG. 1.

Preferably the pins 21 are formed as a pin assembly 20 comprising a body 23 as shown particularly in FIG. 2. Preferably the pin assemblies 20 comprise aligning means such as studs 24 in the body 23 which are inserted in corresponding stud holes of the support surface 12. Preferably the support 11 comprises slides 14 which are mounted movable in channels 15 below the support surface 12. The slides 14 comprise a hole 14' corresponding to the pin holes 13 in the support surface and the lower portion 22 of the pins. Preferably two slides 14 are positioned in place in the support 11 opposite the pin holes 13 which correspond to the size of the head involved. Each pin is inserted into the slides 14 through the support surface 12 so that the head-tool assembly is correctly in position. The support surface 12 comprises locking holes 16 for receiving the locking bolts 17 which are inserted through the support surface 12 and tightened in corresponding locking threads of the slides 14. Preferably the pin assemblies 20 comprise fixing means such as fixing holes (not shown in the figures) for receiving the locking bolts 17 which are inserted through the support surface 12 and tightened in corresponding locking threads of the slides 14. Preferably the locking holes 16 in the support surface 12 are longitudinal to enable sliding of the slides 14 without need to detach the locking bolts 17.

The head 2 may be locked also vertically relative to the support 11. The pin assemblies 20 can be fixed vertically to the support. Preferably the pin assembly 20 comprises a stop screw 25 in the body 23 which allows locking of the head vertically relative to the head assembly 20. For aligning the head onto the support 11 the stop screw 25 is released to allow the head to be put in place.

After the head assembly 1, 2 is fitted in place on the support 11 the lifting equipment is removed and the stop screws 25 are tightened. The head bolt 4 is screwed by hand to its end stop onto the head. The drive sleeve 40 is positioned on the head bolt 4. Preferably the drive sleeve 40 is equipped with a lifting ring during lifting for handling the sleeve.

The reaction arm 32 is lifted on an appropriate level using lifting equipment and fitted on the support stage 31 of the mast 30 which is corresponding the size of the head assembly. The mast 30 may include for instance four distinct support stages 31 intended for various sizes of crushers.

The tightening wrench 50 is lifted in place preferably with the reaction arm 32. After that the wrench is positioned on the drive sleeve 40. During the tightening operation the tightening wrench can be held using lifting equipment to stop it from falling.

The wrench 50 is preferably hydraulic but also other types of wrenches may be used. Preferably the tightening wrench is torque adjustable. The hydraulic power transmission is safe and controllable because of the minor amount of moving machine elements under compression.

The torque of the hydraulic wrench 50 can be adjusted by adjusting the pressure of the supplied hydraulic medium. Preferably the operating pressure of the hydraulic wrench of the tool 10 is adjusted by energizing a hydraulic supply pump for the hydraulic wrench, referring to a pressure gauge of the hydraulic system and operating an adjustable safety valve of the hydraulic system till a prescribed hydraulic pressure is achieved. Preferably the torque adjustment is carried out before placing the torque wrench on the remaining tool equipment. The pressure and torque values are depending on the type of crusher.

The foregoing description provides non-limiting examples of some embodiments of the invention. It is clear to a person skilled in the art that the invention is not restricted to details presented, but that the invention can be implemented in other equivalent means.

Some of the features of the above-disclosed embodiments may be used to advantage without the use of other features. As such, the foregoing description shall be considered as merely illustrative of the principles of the invention, and not in limitation thereof. Hence, the scope of the invention is only restricted by the appended patent claims.

I claim:

1. A head bolt tightening tool comprising:

a support having a support surface configured to support a cone crusher head assembly non-rotatably on the support surface;

a reaction arm fitted to the support and configured to hold a head bolt tightening wrench non-rotatably relative to the support; and rotation preventing means mountable to the support and configured to prevent rotation of the cone crusher head assembly when supported on the support surface, wherein the rotation preventing means is adjustable laterally relative to a rotational axis of the cone crusher head assembly to accommodate various cone crusher head assembly sizes.

2. The tool according to claim 1, further comprising a plurality of pins configured to be placed in holes in the cone crusher head assembly and a plurality of pin holes in the support surface of the support.

3. The tool according to claim 2, wherein the support surface comprises the plurality of pin holes for lower portions of the pins at prescribed distances relative to each other corresponding to the sizes of various cone crusher head assembly sizes.

4. The tool according to claim 2, wherein the support comprises slides with a plurality of holes corresponding to the plurality of pin holes in the support surface.

5. The tool according to claim 2, wherein the support comprises slides with a plurality of holes corresponding to the plurality of pin holes in the support surface and the slides are lockable in the support opposite the plurality of pin holes which correspond to the size of the head involved in the tightening.

6. The tool according to claim 2, further comprising a drive sleeve configured to be placed between the head bolt and the tightening wrench.

7. The tool according to claim 2, wherein the tightening wrench is a torque wrench.

8. The tool according to claim 2, wherein the tightening wrench is a hydraulic wrench.

9. The tool according to claim 1, wherein the reaction arm comprises a mast, wherein the reaction arm is fitted to the mast.

10. The tool according to claim 9, wherein the mast is fitted to the support.

11. The tool according to claim 10, wherein the mast comprises support stages on different heights for level adjustment of the reaction arm.

12. The tool according to claim 9, wherein the mast comprises a plurality of distinct support stages on different heights for level adjustment of the reaction arm.

13. The tool according to claim 9, wherein the tightening wrench is a torque wrench.

14. The tool according to claim 9 wherein the tightening wrench is a hydraulic wrench.

15. The tool according to claim 1, wherein a mantle is mounted on the cone crusher head assembly.

16. The tool according to claim 1, further comprising a drive sleeve configured to be placed between the head bolt and the tightening wrench.

17. The tool according to claim 1, wherein the tightening wrench is a torque wrench.

18. The tool according to claim 1, wherein the tightening wrench is a hydraulic wrench.

* * * * *